US010994434B2

(12) United States Patent
Rohrbach

(10) Patent No.: US 10,994,434 B2
(45) Date of Patent: May 4, 2021

(54) KNIFE

(71) Applicant: MARTOR KG, Solingen (DE)

(72) Inventor: Martin Rohrbach, Solingen (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 14/915,541

(22) PCT Filed: Sep. 5, 2014

(86) PCT No.: PCT/DE2014/000451

§ 371 (c)(1),
(2) Date: Apr. 29, 2016

(87) PCT Pub. No.: WO2015/032380

PCT Pub. Date: Mar. 12, 2015

(65) Prior Publication Data

US 2016/0229074 A1 Aug. 11, 2016

(30) Foreign Application Priority Data

Sep. 5, 2013 (DE) ..... 10 2013 014 684.4

(51) Int. Cl.
*B26B 29/02* (2006.01)
*B26B 5/00* (2006.01)

(52) U.S. Cl.
CPC ..... *B26B 29/02* (2013.01); *B26B 5/00* (2013.01)

(58) Field of Classification Search
CPC ..... B26B 29/02; B26B 29/025; B26B 1/00; B26B 1/02; B26B 5/00
USPC ..... 30/2, 151, 153, 155–161, 286, 288, 294, 30/320, 329, 340; 606/167
See application file for complete search history.

(56) References Cited

U.S. PATENT DOCUMENTS 365,714 A * 6/1887 Warner ..... B26B 29/02 30/282
1,299,084 A * 4/1919 Wilson ..... A22C 21/06 452/120
1,452,893 A * 4/1923 Porth ..... A22B 5/168 30/286
2,209,751 A * 7/1940 Wulff ..... B26B 5/006 30/2
2,376,887 A * 5/1945 Walters ..... B26B 29/02 30/286
2,730,800 A * 1/1956 Bailey ..... B26B 29/02 30/153
2,743,523 A * 5/1956 Honey ..... B26B 29/02 30/2

(Continued)

FOREIGN PATENT DOCUMENTS

DE 1121972 A 1/1962
DE 8902653 U 5/1989

*Primary Examiner* — Jason Daniel Prone
(74) *Attorney, Agent, or Firm* — Andrew Wilford

(57) ABSTRACT

A knife has a housing, a blade having a cutting edge and mounted on the housing with the edge extending transversely of a predetermined direction. An actuator is movable on the housing and pivots a blade guard on the housing about a guard axis for movement in the predetermined direction from a safety position in which the blade guard covers the cutting edge of the blade into a cutting position in which the blade guard is spaced from the cutting edge and the cutting edge is freely accessible and from the cutting position in a direction opposite the predetermined position into the safety position.

7 Claims, 4 Drawing Sheets

(56) References Cited

U.S. PATENT DOCUMENTS 3,430,339 A * 3/1969 Hobson ..... B26B 27/00 30/151
3,781,988 A * 1/1974 Jones ..... B26B 29/02 30/2
4,086,698 A * 5/1978 Sparks ..... B26B 29/02 30/2
4,091,537 A * 5/1978 Stevenson, Jr. ..... B26B 29/02 30/151
4,157,616 A * 6/1979 Lundqvist ..... B26B 29/02 30/153
4,531,286 A * 7/1985 Vito ..... B26B 29/02 30/2
4,980,977 A * 1/1991 Matin ..... B26B 29/02 30/151
4,987,682 A * 1/1991 Minnick ..... B26B 29/02 30/289
5,116,351 A * 5/1992 Frassetti ..... A61B 17/3211 30/161
5,241,750 A * 9/1993 Chomiak ..... B26B 29/02 30/2
5,250,064 A * 10/1993 Schneider ..... A61B 17/3211 30/151
5,330,494 A * 7/1994 van der Westhuizen ..... A61B 17/3211 30/151
5,478,346 A * 12/1995 Capewell ..... B26B 29/02 30/151
5,522,135 A * 6/1996 Votolato ..... B26B 29/02 30/2
5,522,828 A * 6/1996 Malilay ..... A61B 17/3211 30/153
5,581,893 A * 12/1996 Ouellette ..... B26B 29/02 30/286
5,676,677 A * 10/1997 Landis ..... A61B 17/3211 606/167
5,697,157 A * 12/1997 Votolato ..... B26B 29/02 30/2
5,843,107 A * 12/1998 Landis ..... A61B 17/3211 606/167
5,852,874 A * 12/1998 Walker ..... B26B 29/02 30/2
5,890,290 A * 4/1999 Davis ..... B26B 29/02 30/2
6,070,326 A * 6/2000 Berns ..... B26B 29/02 30/2
6,178,640 B1 * 1/2001 Votolato ..... B26B 27/005 30/2
6,189,218 B1 * 2/2001 Okada ..... B26B 25/005 30/2
6,233,832 B1 * 5/2001 Berns ..... B26B 29/02 30/286
6,327,783 B1 * 12/2001 Ming ..... B26B 25/005 30/286
6,560,873 B1 * 5/2003 Ortner ..... B26B 29/02 30/2
6,578,266 B2 * 6/2003 Chomiak ..... B26B 29/02 30/2
6,643,936 B2 * 11/2003 Carlson ..... B26B 25/005 30/292
6,718,637 B1 * 4/2004 Ortner ..... B26B 29/02 30/2
6,748,659 B1 * 6/2004 Street ..... B26B 29/02 30/2
7,024,772 B1 * 4/2006 Shaver ..... B26B 29/02 30/2
7,082,688 B2 * 8/2006 Votolato ..... B26B 29/02 30/2
7,204,023 B2 * 4/2007 Chang ..... B26B 29/02 30/2
7,356,928 B2 * 4/2008 Votolato ..... B26B 29/02 30/153
7,475,480 B2 * 1/2009 Votolato ..... B26B 29/02 30/2
7,485,126 B2 2/2009 Adelman
7,509,742 B2 * 3/2009 Votolato ..... B26B 29/02 30/151
7,726,029 B2 * 6/2010 Votolato ..... B26B 29/02 30/151
7,774,942 B2 * 8/2010 Schmidt ..... B26B 29/02 30/286
7,810,241 B2 * 10/2010 Pooler ..... A61B 17/3211 30/151
7,886,443 B2 * 2/2011 Votolato ..... B26B 29/02 30/151
7,966,732 B2 * 6/2011 Votolato ..... B26B 29/02 30/151
D644,493 S * 9/2011 Bignon ..... D7/649
8,046,922 B2 * 11/2011 Eby ..... B26B 29/02 30/151
8,099,868 B1 * 1/2012 Votolato ..... B26B 29/02 30/2
8,117,754 B2 * 2/2012 Lion ..... B26B 29/02 30/153
8,122,605 B2 2/2012 Votolato
8,127,452 B2 * 3/2012 Garavaglia ..... B26B 29/02 30/151
8,209,870 B2 * 7/2012 Votolato ..... B26B 29/02 30/151
8,234,790 B2 * 8/2012 Schmidt ..... B26B 29/02 30/151
8,250,764 B2 * 8/2012 Davis ..... B26B 5/003 30/162
8,307,556 B2 * 11/2012 Davis ..... B26B 5/003 30/162
8,347,509 B2 * 1/2013 Votolato ..... B26B 29/02 30/151
8,561,305 B2 * 10/2013 Davis ..... B26B 5/003 30/162
8,720,068 B2 * 5/2014 Landwehr ..... B26B 29/02 30/2
8,732,956 B2 * 5/2014 McGushion ..... B26B 29/02 30/151
8,752,297 B2 * 6/2014 Rohrbach ..... B26B 5/003 30/158
8,931,180 B2 * 1/2015 Davis ..... B26B 5/003 30/162
9,003,668 B2 * 4/2015 Landwehr ..... B26B 5/00 30/153
9,027,254 B1 * 5/2015 Vodinh ..... B26B 29/02 30/151
9,656,402 B2 * 5/2017 Roth ..... B26B 29/02 30/292
9,676,107 B2 * 6/2017 Garavaglia ..... B26B 29/02 30/125
D865,479 S * 11/2019 Rohrbach ..... D8/99
2002/0124412 A1 * 9/2002 Votolato ..... B26B 29/02 30/200
2004/0187318 A1 * 9/2004 Mathieu ..... B26B 29/00 30/319
2006/0248725 A1 * 11/2006 Huang ..... B67B 7/30 30/2
2008/0010839 A1 * 1/2008 Eby ..... B26B 25/005 30/319
2009/0094839 A1 4/2009 Votolato
2009/0260235 A1 * 10/2009 Rohrbach ..... B26B 5/003 30/162
2011/0035947 A1 * 2/2011 Rohrbach ..... B26B 5/003 30/162
2011/0119925 A1 * 5/2011 Rohrbach ..... B26B 5/003 30/158
2011/0302787 A1 * 12/2011 Rohrbach ..... B26B 5/001 30/162
2016/0158945 A1 * 6/2016 Herlitz ..... B26B 5/003 30/162
2016/0325442 A1 * 11/2016 Herlitz ..... B26B 1/08 30/162

(56) References Cited

U.S. PATENT DOCUMENTS

| | | | | |
|---|---|---|---|---|
| 2017/0120462 | A1* | 5/2017 | Votolato | B26B 29/02 30/153 |
| 2017/0120469 | A1* | 5/2017 | Votolato | B26B 29/025 30/153 |
| 2017/0274544 | A1* | 9/2017 | Stiles | B26B 29/02 30/151 |
| 2017/0291317 | A1* | 10/2017 | Votolato | B26B 29/02 30/151 |
| 2020/0023528 | A1* | 1/2020 | Rohrbach | B26B 5/001 |
| 2020/0276721 | A1* | 9/2020 | Rohrbach | B26B 5/001 |
| 2020/0338767 | A1* | 10/2020 | Rohrbach | B26B 5/003 |

* cited by examiner

KNIFE

CROSS REFERENCE TO RELATED APPLICATIONS

This application is the US-national stage of PCT application PCT/DE2014/000451 filed 5 Sep. 2014 and claiming the priority of German patent application 102013014684.4 itself filed 5 Sep. 2013.

FIELD OF THE INVENTION

The invention relates to a knife. The knife has a housing on which a blade is mounted. The blade is for example mounted in a blade holder. The knife has a blade guard mounted on the housing so as to be movable between at least one safety position in which a cutting edge of the blade is covered by the blade guard and a cutting position in which the cutting edge is freely accessible.

BACKGROUND OF THE INVENTION

Such a knife is known from US 2009/0271988. Here a blade guard is pivotal on the housing. A blade holder is also pivotal on the housing. A securing lever pivotal on the blade guard prevents movement of the blade guard when an end of the securing lever engages with a stop on the housing. A handle can move the securing lever out of engagement with the stop so that movement of the blade guard is possible.

Setting the knife on the material to be cut pivots the blade guard out of a safety position in which it projects out of the housing and into a cutting position in which it is retracted into the housing. The blade holder is coupled to the blade guard in such a way that in the event of movement of the blade guard out of the safety position into the cutting position, the blade holder is pivoted out of a rear position in which a blade merely projects slightly out of the housing into a front position in which a cutting operation is possible.

However, such a knife has the disadvantage that the blade guard must be placed on the material to be cut in order to move it into the cutting position, which is often undesirable in particular in the case of delicate materials.

OBJECT OF THE INVENTION

It is the object of the invention to provide a knife that offers the user greater safety. It is a further object of the invention to provide a knife that can also be used with delicate material. It is also an object of the invention to create a knife that can have a narrower construction in a front knife region, in particular the blade outlet region.

SUMMARY OF THE INVENTION

In the knife according to the invention an actuator is provided that can move the blade guard between the safety position and the cutting position. For example, the actuator has a handle that is movable between an unactuated position and an actuated position. By movement of the handle of the actuator from the unactuated position into an actuated position, the blade guard is for example moved out of the safety position into the cutting position. The blade guard is for example biased by a spring into the safety position.

The actuator has the entire drive train of the blade guard. For example, the actuator has a handle by means of which a user of the knife can actuate the blade guard. The handle is movable for example between an unactuated position and an actuated position. In the unactuated position the blade guard is for example in the safety position. In the actuated position the blade guard is for example in a cutting position. The end actuated position of the handle is designated below as the actuated position. One or more actuating elements that are movably connected to one another are formed between the handle and the blade guard. For example, the blade holder can also be part of the actuator when the blade guard is movably connected to the blade holder.

In a safety position a cutting edge of the blade is covered by the blade guard. In this case the blade guard is positioned in such a way relative to the cutting edge that the user cannot be injured on the cutting edge. In the cutting position the blade guard is separated from the cutting edge such that a cutting operation is possible and the user can set the blade on the material to be cut.

The blade can be fastened, for example releasably, in a blade holder. The blade holder can have nonpositive locking means and positive locking means, in order to hold the blade in a specific position. Conventional means are for example projections from the blade holder that engage in openings in the blade. Also a projection can partially fit with the shape of the blade. For example, the blade holder can also comprise a blade seat and a flap, and the blade is between the seat and the flap.

According to an embodiment the blade is normally immovably fixed on the housing. This means that the blade in the fitted state is immovable relative to the housing. Nevertheless it can be releasable for example for replacement of a blade.

According to an alternative embodiment, in order to hold the blade, the blade or a blade holder is held movably on the housing. The blade can be movable for example between at least one rest position and at least one working position. The blade is for example movable between a first and a second end position as well as a first and a second working position. In the end position the blade is positioned so that a cutting edge of the blade is covered by the blade guard. The blade guard is for example in the safety position when the blade is in the end position. In the working position of the blade the blade guard is for example in the cutting position.

The blade or the blade holder can for example be moved against the blade guard. For example, the blade and the blade guard have different pivoting directions. In this way the safety state can be restored more quickly. Furthermore, a smaller movement of the blade guard is necessary in order to produce the safety position. Also, for example, in this way the blade can be moved at least partially into the housing of the knife, so that in the end position of the blade the blade guard merely has to cover the part of the cutting edge that projects out of the housing. The blade or the blade guard are for example biased by a spring into the rest position.

The blade can for example be mounted on the housing so as to pivot between at least one rest position and at least one working position. For example, the blade or a blade holder forms a pivot with the housing. The pivoting movement of the blade is for example combined with a straight-line movement. According to an alternative embodiment, the blade is moved only in a straight line. The pivotable blade can for example trigger the release of the coupling elements of a coupling of the actuator.

The blade guard is for example pivotal on the housing. For example, the blade guard and the housing form a pivot. The pivoting of the blade guard is for example combined with a straight-line movement. According to an alternative embodiment, the blade guard is moved only in a straight line.

The actuator has for example a crank drive. For example, an actuating element of the actuator is fastened eccentrically, i.e. spaced from the pivot axis, to the pivotable blade or to a pivotal blade holder and can drive the blade or the blade holder in rotation. According to an alternative embodiment, an actuating element of the actuator is fastened eccentrically to a pivotal blade guard, so that in this way the blade guard can be moved in rotation.

The knife for example has automatic movement of the blade guard back into the safety position. The actuator has, for example between the blade guard and a handle of the actuator, a coupling with a first coupling element associated with the handle and a second coupling element associated with the blade guard. The first coupling element and the second coupling element are movable releasably into engagement. The second coupling element is for example movably connected to the blade, in order to decouple the coupling elements by movement of the blade. The separation of the coupling elements then for example enables the blade guard to move back, even when the handle remains in the actuated position.

In order to provide automatic retraction of the blade guard into the safety position, according to an alternative embodiment the knife has a different coupling. In this case, the coupling has a first coupling element associated with the actuator or the blade guard and a second coupling element associated with the housing. The first coupling element and the second coupling element are also movable releasably into engagement in this embodiment. The first coupling element is for example movably connected to the blade, in order to decouple the coupling elements by movement of the blade.

Also in this case the release of the coupling elements enables the blade guard to move back, even when the handle remains in the actuated position.

The first coupling element and the second coupling element are for example movable when the blade moves from a first working position into a second working position. For example, one of the coupling elements is connected to the blade in such a way that movement of the blade disengages the coupling elements from each other.

According to another embodiment the decoupling can take place for example in such a way that, due to a substantial acceleration that occurs when sliding off from the material to be cut, an inertia mass of the coupling is moved. The movement of the inertia mass disengages the coupling elements from each other. According to an alternative embodiment, the coupling elements could be disengaged by a cutting force that acts on the blade and causes movement of the blade holder.

The actuator is for example designed in such a way that, during movement into the safety position, the blade guard is pivoted forward toward a side of the blade provided with the cutting edge. Thus, during forward movement into the safety position the blade guard initially covers the cutting edge of the blade. This has the advantage that the blade guard can make the knife safe again very quickly. When the blade guard moves over the cutting edge from a side opposite the cutting edge, it takes longer to make the knife safe.

BRIEF DESCRIPTION OF THE DRAWING

Further advantages of the invention are disclosed with reference to the description of an embodiment shown in the drawings. Therein.

SPECIFIC DESCRIPTION OF THE INVENTION

Figure 1:
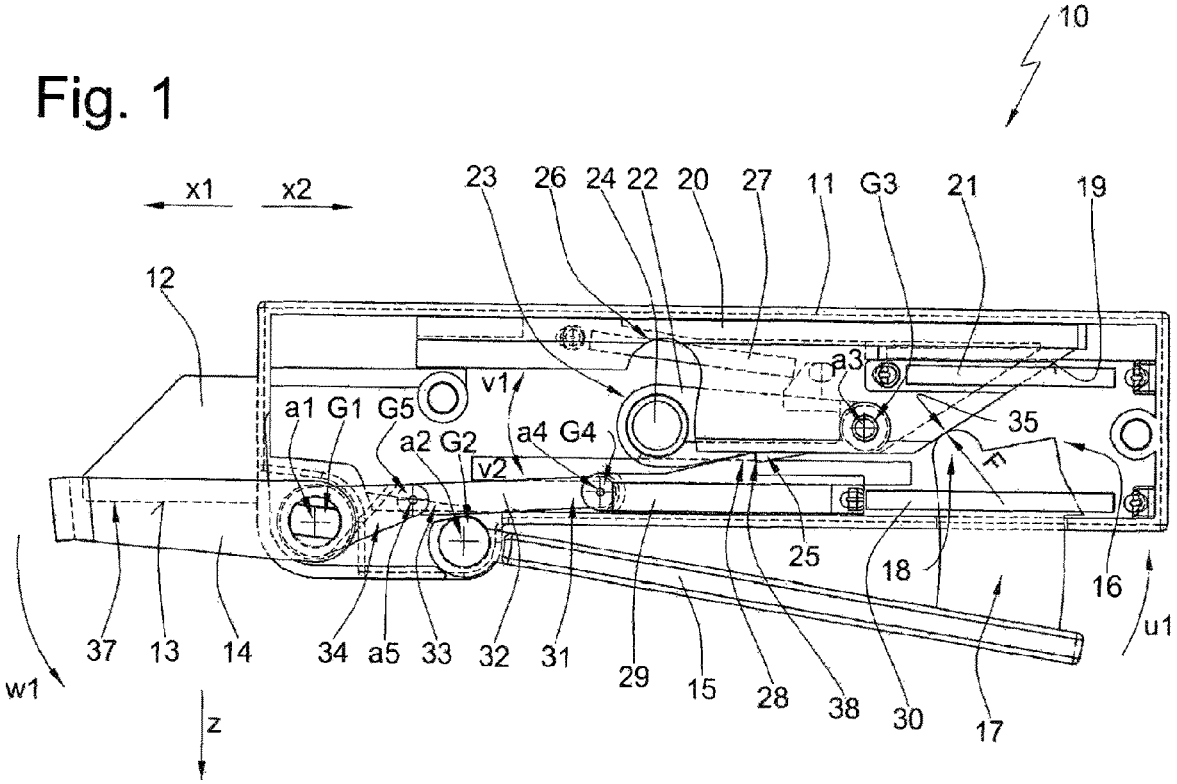
FIG. 1 is a schematic sectional view of a first embodiment of the knife with a blade fixed to the housing, the handle unactuated, and the blade guard in a safety position.

The knife according to the first embodiment as a whole is designated in FIGS. 1 to 4 with reference numeral 10. The same reference numerals in the different figures of the first embodiment designate corresponding parts.

According to FIG. 1, the knife 10 has a housing 11 that forms a handle by which the knife 10 can be held by the user. A blade 12 is mounted on the housing 11. In this embodiment the blade 12 is fixed on the housing 11, and a tip of the blade 12 projects out of the housing 11. The blade 12 has a cutting edge 13 facing angularly and extending radially from a pivot axis a1. For the invention it is irrelevant whether the blade 12 is fixed or movable on the housing 11. According to an alternative embodiment, the blade could also be movable on the housing.

A blade guard 14 is mounted on the housing 11 so as to pivot about the pivot axis a1 between a safety position and a cutting position and forms a pivot G1 with the housing 11. The blade guard 14 is a clip and, in the safety position shown in FIG. 1, fits around the blade 12 in such a way that it is inaccessible for a user, so that the user cannot be injured by it.

A handle 15 is mounted on the housing 11 so as to pivot about a pivot axis a2 between an unactuated position and an actuated position and forms a pivot G2 with the housing 11. The end actuated position of the handle is designated below according to FIGS. 2, 3 and 4 as the "actuated position." The handle 15 moves the blade guard 14 between the safety position and the cutting position shown in FIG. 2. The handle 15 is part of an actuator 16.

In the illustrated embodiment the handle 15 is formed by a lever pivotal on the housing 11, although this is not important for the invention. In fact, according to an alternative embodiment, the handle 15 could also be formed by a slider.

The handle 15 has an extension 17 with a cam 18. The cam 18 engages with an oblique surface 19 of a slide 20 inclined with respect to its directions of movement x1 and x2. The slide 20 is mounted in the housing 11 so as to be movable in the directions x1 and x2 between a rear position and a front position. A spring 21 is fastened with one end to the slide 20 and with the other end to the housing 11 and biases the slide 20 into a rear position shown in FIG. 1. The handle 15 is also biased into the unactuated position indirectly by the spring 21 via the contact between the slide 20 and the cam 18.

A coupling lever 22 is pivotal on the slide 20 about a pivot axis a3 between an engaged position and a release position and forms a pivot G3 with the slide 20. The coupling lever 22 is biased into the engaged position of FIG. 1 by a spring 27 fastened with one end to the housing 11 and with another end to the coupling lever 22. A weight 24 is carried on the coupling lever 22. The weight 24 is in particular fastened to a free end 23 of the coupling lever 22. Furthermore, the coupling lever 22 is provided with a first coupling projection 25.

The first coupling projection 25 engages a second coupling projection 28 of a coupling slide 29. The coupling projections 25 and 28 form a coupling 38. In the engaged position the coupling lever 22 is positioned in such a way that the first coupling projection 25 can engage the second coupling projection. In the release position the coupling projections 25 and 28 are disengaged.

The coupling slide 29 is mounted in the housing 11 so as to be movable in the directions x1 and x2 between a rear position and a forward position. A spring 30 fastened with one end to the housing and with another end to the coupling slide 29 biases the slide 29 into the rear position.

A first end 31 of a link 32 forms with the coupling slide 29 a pivot G4 having a pivot axis a4. A second end 33 of the link 32 forms with the coupling slide 34 a pivot G5 having the pivot axis a4.

Figure 2:
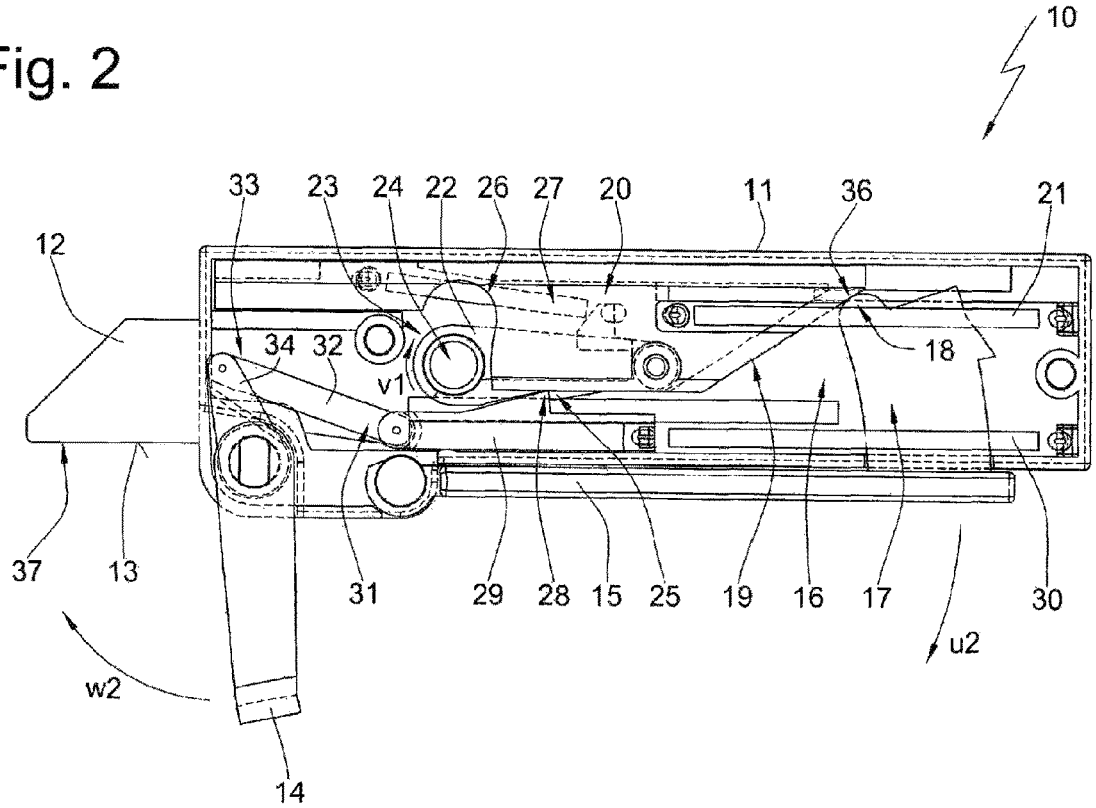
FIG. 2 shows, like FIG. 1, the knife with the handle in an actuated position and the blade guard in a cutting position.
Figure 3:
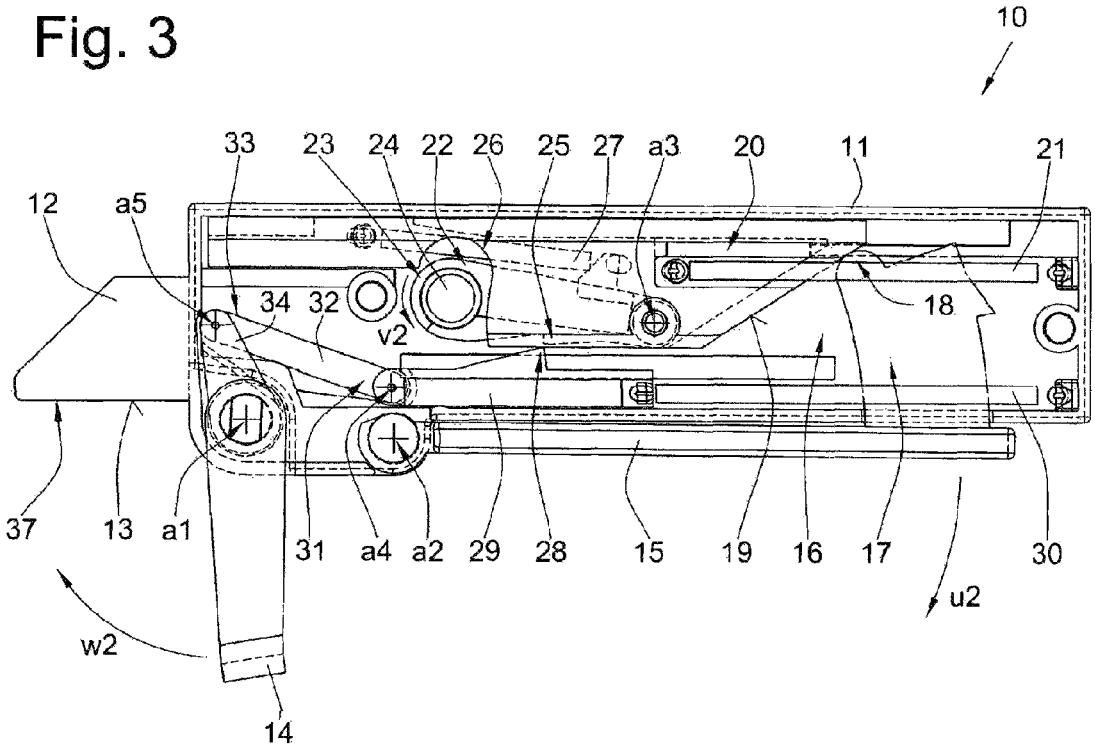
FIG. 3 shows, like FIG. 2, the knife with the coupling elements of an actuator separated from one another.
Figure 4:
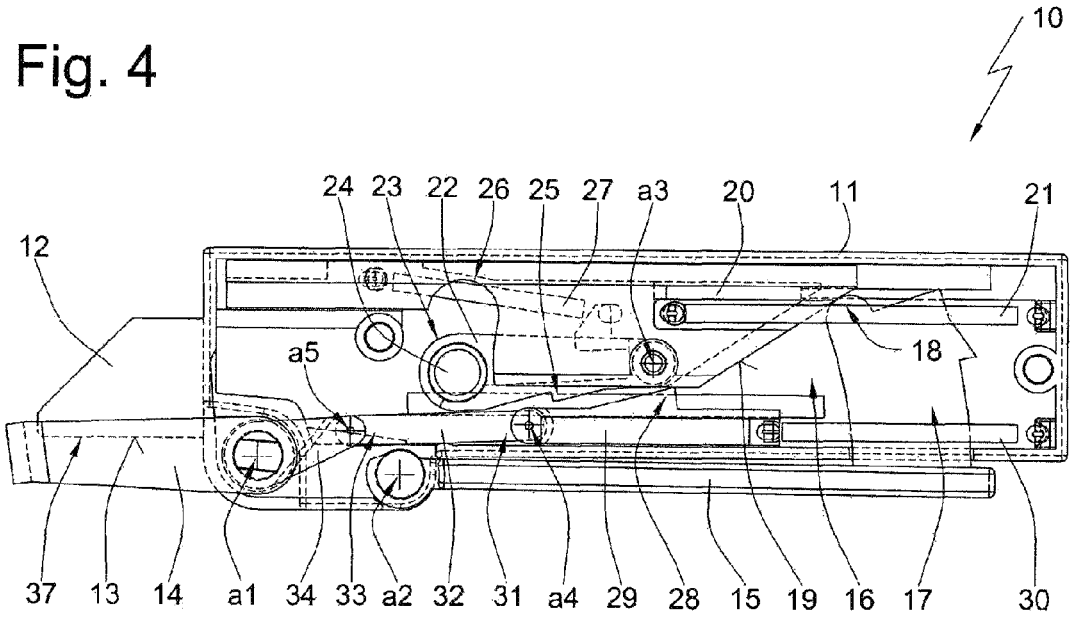
FIG. 4 shows, like FIG. 3, the knife with the handle in the actuated position and the blade guard in the safety position.

In order to carry out a cutting operation, the handle 15 is pivoted out of the unactuated position of FIG. 1 in the direction u1 into the actuated position of FIG. 2. In this case the cam 18 exerts a force F on the inclined surface 19. The force F has a component that acts in the direction x1, so that the slide 20 is moved against the force of the spring 21 out of the rear position of FIG. 1 in the direction x1 into the front position (see FIG. 2), and the cam 18 slides on the inclined surface 19 from a first point 35 to a second point 36. The coupling lever 22 pivotal on the slide 20 is also moved in the direction x1. The first coupling projection 25 of the coupling lever 22 engages the second coupling projection 28 of the coupling slide 29 so that it is also moved against the force of the spring 30 out of the rear position in the direction x1 into the forward position.

When the coupling slide 29 is moved into the forward position, it pivots the blade guard 14 by the link 32 and the lever arm 34 in the direction w1 into the cutting position (see FIG. 2).

The knife 10 has an automatic blade guard return movement. If, during cutting, the user should slide off the material to be cut, due to the sudden movement downward in the direction z the coupling lever 22 is pivoted because of the mass moment of inertia against the spring force of the spring 27 in the direction v1, and the first coupling projection 25 and the second coupling projection 28 move out of engagement (see FIG. 3) with each other. In order that the coupling lever 22 can pivot in the direction v1, a cutout 26 is provided on the slide 20. Then the coupling slide 29 is moved by the spring 30 into the rear position, thereby moving the blade guard 14 by the link 32 and the lever arm 34 in the direction w2 into the safety position (see FIG. 4), although the handle 15 is still in the actuated position. During movement into the safety position, the blade guard 14 is moved forward toward a side 37 of the blade 12 provided with the cutting edge 13.

As the force on the handle 15 diminishes, the slide 20 is moved back by the spring 21 into the rear position and the handle 15 is also moved indirectly in the direction u2 into the unactuated position. The first coupling projection 25 of the coupling lever 22, which is biased by the spring 27 in the direction v2, moves again into engagement with the second coupling projection 28 of the coupling slide 29 (see FIG. 1).

A second embodiment of the knife is shown in FIGS. 5 to 8. The knife according to the second embodiment is designated overall by the reference numeral 110. The same reference numerals in the different drawings of the second illustrated embodiment designate corresponding parts.

The knife 110 has a housing 111. A blade holder 112 can pivot on the housing 111 between a first end position shown in FIG. 5, a first working position shown in FIG. 6, a second working position shown in FIG. 7 and a second end position shown in FIG. 8. The blade holder 112 forms with the housing 111 a pivot G2 having a pivot axis a2. A blade 113 with a cutting edge 114 is releasably held in the blade holder 112.

A blade guard 115 forms with the housing 111 a pivot G1 having a pivot axis a1. The blade guard 115 can move between a first safety position shown in FIG. 5, a first cutting position shown in FIG. 6, a second cutting position shown in FIG. 7 and a second safety position shown in FIG. 8. In the first and second safety positions the blade guard 115 fits over a cutting edge 114 in such a way that the cutting edge 114 is inaccessible for a user. In the first cutting position the blade guard 115 is moved away from the cutting edge 114, so that the cutting edge 114 can be placed on the material to be cut and a cut can be made.

The blade holder 112 and the blade guard 115 are coupled for joint movement. The blade guard 115 is in the first safety position when the blade holder 112 is in the first end position (see FIG. 5). When the blade holder 112 moves into the first working position, the blade guard 115 moves into the first cutting position (see FIG. 6), and when the blade holder 112 moves into the second working position, the blade guard 115 moves into the second cutting position (see FIG. 7). The blade guard 115 is in the second safety position when the blade holder 112 is in the second end position (see FIG. 8).

The coupling in terms of movement takes place for example by teeth 116 of the blade holder 112 that mesh with teeth 117 of the blade guard 115. In this way the blade holder 112 and the blade guard 115 pivot in opposite directions. This means that when the blade holder 112 pivots in the direction u1 the blade guard 115 pivots in the direction w1, and when the blade holder 112 pivots in the direction u2 the blade guard 115 pivots in the direction w2.

A handle 118 is part of an actuator mechanism 122 and is provided for actuation of the blade holder 112 as well as the blade guard 115. The handle 118 is movable in a straight line in the directions x1 and x2 between an unactuated position shown in FIG. 5 and an actuated position shown in FIG. 6. The handle 118 is movable out of the unactuated position in the direction x1 into the actuated position. The handle 118 is movable out of the actuated position in the direction x2 into the unactuated position. The handle 118 is biased into the unactuated position for example by a restoring force of a spring 125 only indicated schematically by a broken line. The spring 125 is fastened to the housing 111 and to the handle 118.

According to an unillustrated alternative embodiment the handle could also be formed by a lever pivotal on the housing 111 as in the first embodiment.

The handle 118 has a first coupling element 119 in the form of a resiliently deformable arm. The first coupling element 119 is for example formed on the handle 118 or is connected to the handle 118. A free end of the first coupling element 119 can be moved into engagement with a second coupling element 120 and can also be separated therefrom. The second coupling element 120 is formed by part of an actuating element 121 of the actuator mechanism 122.

The actuating element 121 is formed by a lever forming on a guide 123 a pivot G3 having a pivot axis a3. The guide 123 is movable in the housing 111 in the directions x1 and x2. The pivot axis a3 is not movable relative to the guide 123, but is movable relative to the housing 111. According to an alternative embodiment that is not illustrated, for example no guide 123 is provided and a pin of the pivot G3 forming the pivot axis a3 is received in a guide slot of the housing 111, and the guide slot allows movement of the pin in the directions x1 and x2 as well as pivoting of the actuating part 121 around the pin.

In this embodiment the actuating element 121 is formed by a two-armed lever. The actuating element 121 has a first lever arm 124 and a second lever arm itself forming the second coupling element 120. A fourth pivot G4 with a pivot axis a4 is formed between the actuating element 121, in particular the first lever arm 124 of the actuating element 121, and the blade holder 112. The pivot G4 is eccentric to the pivot axis a2 on the blade holder 112 so that movement of the actuating part 121 in the direction x1 pivots the blade holder 124 in the direction u1.

Figure 5:
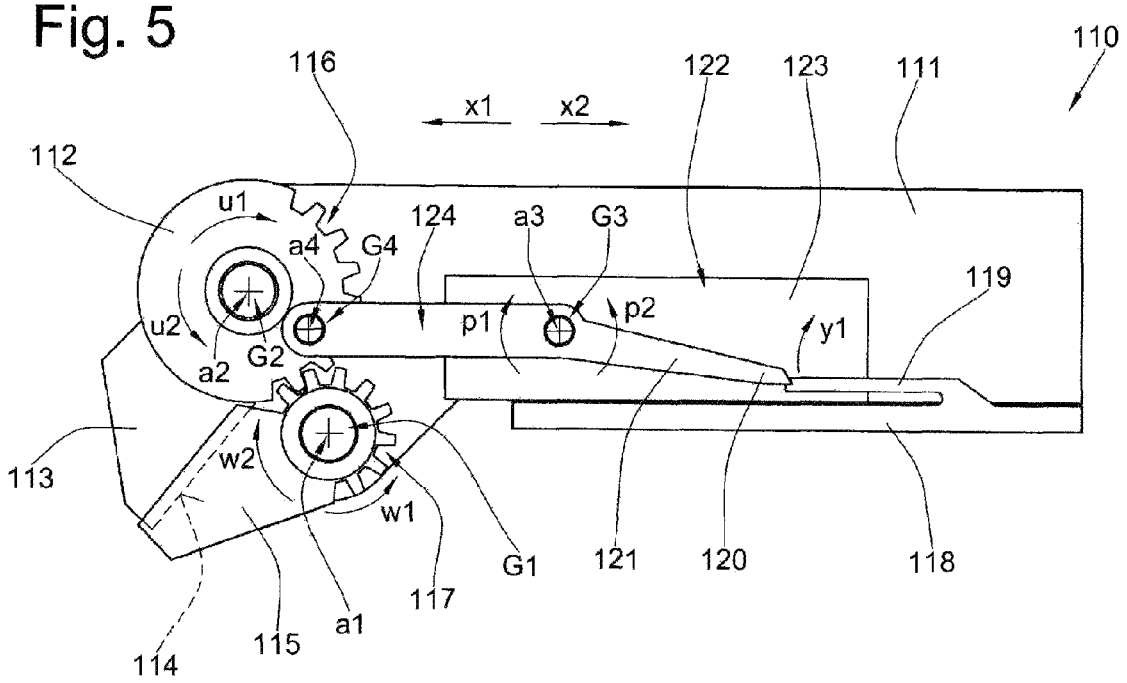
FIG. 5 shows a second embodiment of the knife with the blade movable on the housing and in a end position and the blade guard in the safety position.

In the starting position of the knife of FIG. 5, the first coupling element 119 and the second coupling element 120 are in engagement. According to an alternative embodiment that is not illustrated, after a short movement of the handle 118 out of the unactuated position in the direction x1 the first coupling element 119 and the second coupling element 120 come into engagement, whereas in the unactuated position of the handle 118 they are still disengaged.

Figure 6:
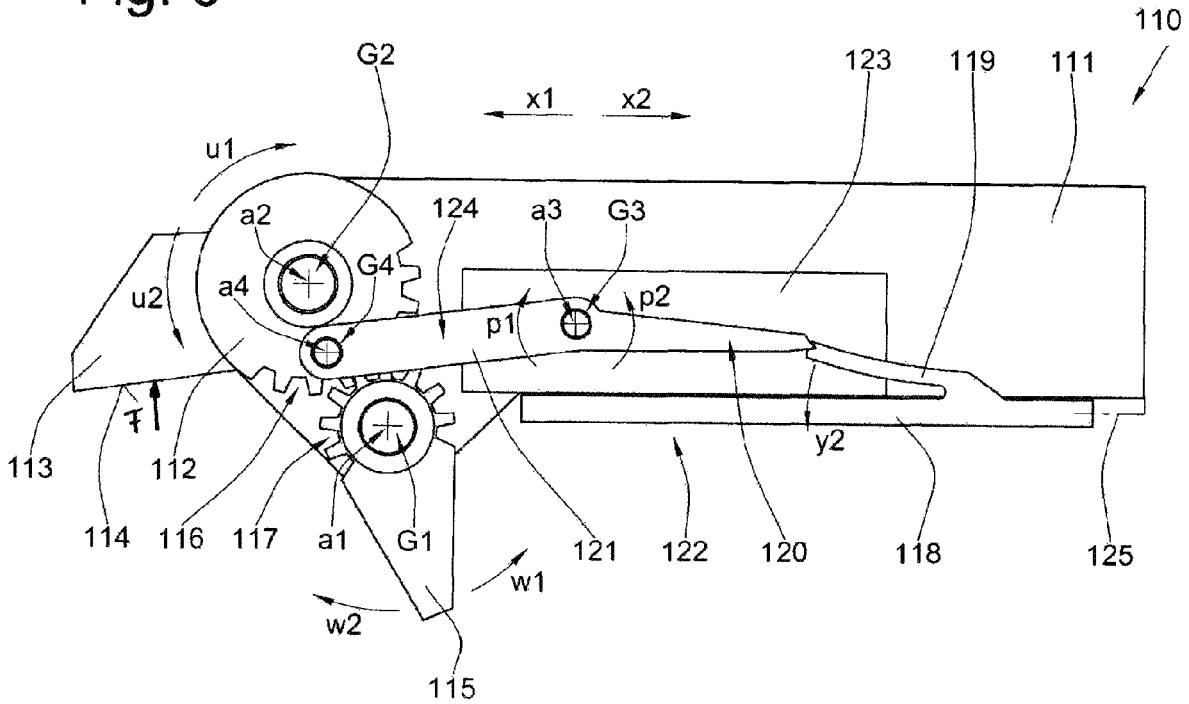
FIG. 6 shows, like FIG. 5, the knife with the handle in an actuated position, the blade guard in a first cutting position, and the blade in a first working position.

When the user moves the handle 118 in the direction x1 out of the unactuated position shown in FIG. 5 into the actuated position of FIG. 6, the actuating element 121 pushes the guide 123 in the direction x1 by the pivot G3. In this case the actuating part 121 pivots the blade holder 112 about the pivot G4 in the direction u1 into the first working position of FIG. 6. The engaged tooth systems 116 and 117 force the blade guard 115 to pivot in an opposite direction of rotation to the blade holder 112 in the direction w1 into the first cutting position that is shown in FIG. 6. Moreover, due to the pivoting of the blade holder 112 the actuating element 121 is also pivoted in the direction p2, and the first coupling element 119 is deflected by its resiliently restoring force in direction y1.

Figure 7:
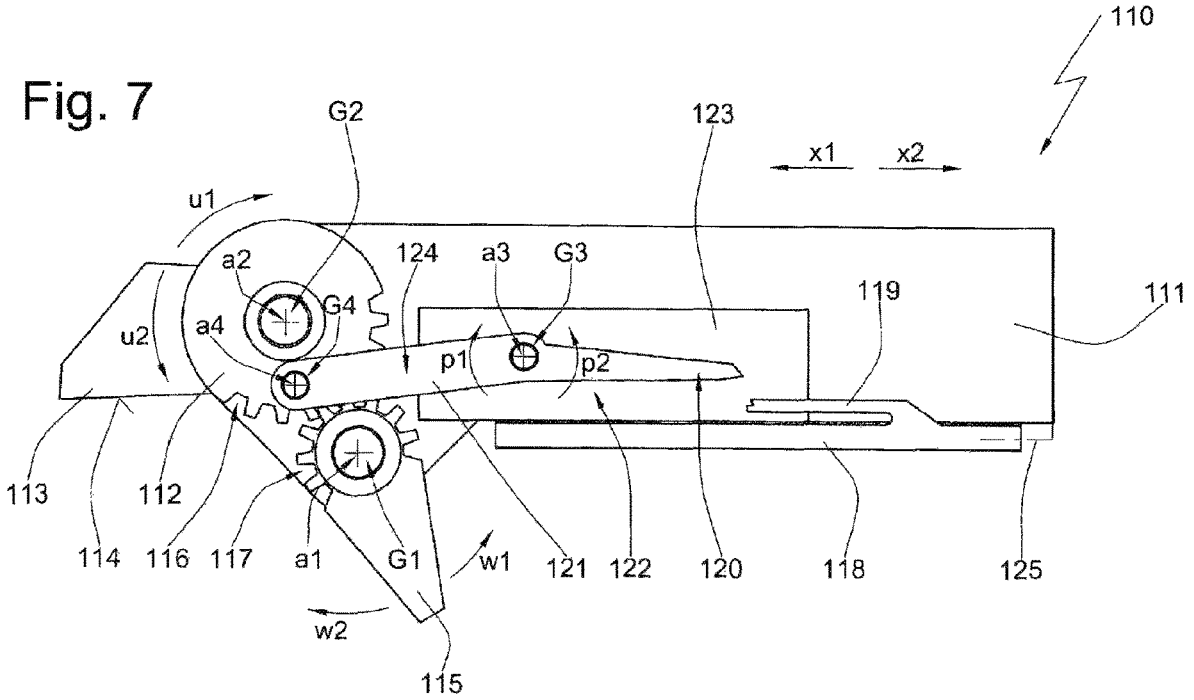
FIG. 7 shows, like FIG. 6, the knife with the handle in the actuated position, the blade guard in a second cutting position, the blade in a second working position, and the coupling elements of an actuator separated from one another.

If, while in the position of FIG. 6, the blade 112 is placed on the material to be cut, a resulting force F on the blade pivots the blade holder 112 in the direction u1 into the second working position and pivots the blade guard 115 in the direction w1 into a second cutting position of FIG. 7. In this case the actuating element 121 is pivoted further in the direction p2 into the position of FIG. 7, and the first coupling element 119 and the second coupling element 120 are released from one another. After release of the coupling elements 119 and 120, the first coupling element 119 is moved back by its resilient restoring force in the direction y2 into its starting position (see FIG. 7).

Figure 8:
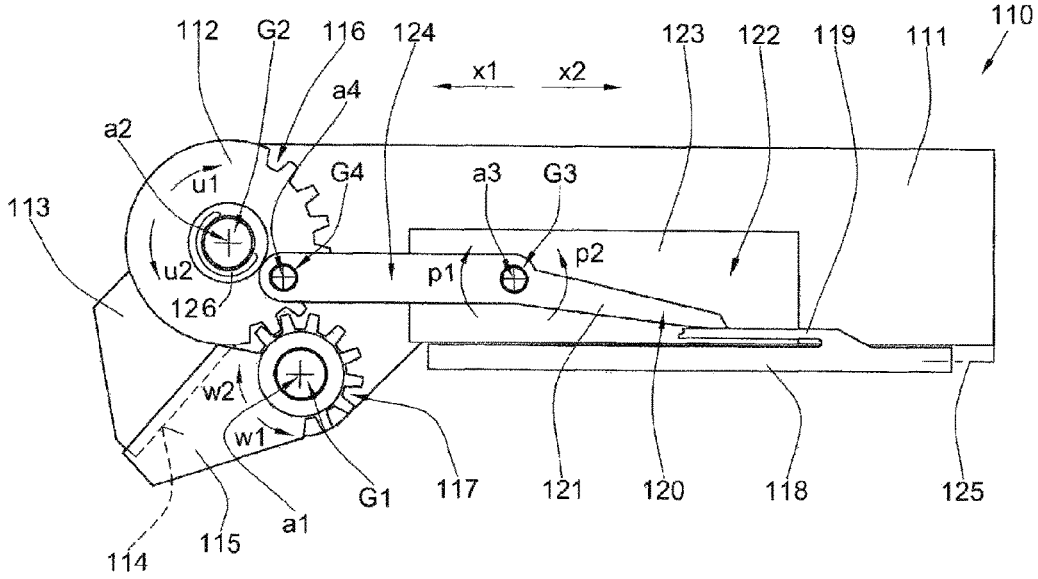
FIG. 8 shows, like FIG. 7 with the handle in the actuated position and the blade guard in the safety position.

After the coupling elements 119 and 120 have been separated from one another, the blade holder 112, which is biased into the rest or safety position by a spring 126 (only shown schematically in part in FIG. 8), can pivot back in the direction u2 into the second end position, even if as shown in FIG. 8 the handle 118 is in the actuated position. Because of movement of the blade holder 112 in the direction u2, the blade guard 115 is pivoted in the direction w2 into the second safety position and the actuating element 121 is pivoted about the pivot axis a3 in the direction p1. Moreover, the guide 123 is moved back in the direction x2. As soon as the handle 118 is released by the user, it is moved by the force of the spring 125 into the unactuated position of FIG. 5. In this case the coupling elements 119 and 120 are brought into engagement again.

The invention claimed is:

1. A utility knife comprising:

an elongated housing defining a longitudinal axis;

a blade holder pivotal on the housing about a holder axis extending transversely to the longitudinal axis of the housing between a cutting position and a safety position;

a blade secured on the holder, pivotal therewith between the safety position and the cutting position, and formed with a cutting edge extending radially of the holder axis;

a blade guard pivotal on the housing about a guard axis extending transversely to the longitudinal axis of the housing and offset from the holder axis, the blade guard being pivotal between a respective safety position shielding the cutting edge when in the blade holder is in the safety position and a respective cutting position spaced angularly about the guard axis from and exposing the cutting edge when the blade holder is in the cutting position;

respective sets of meshing teeth on the guard and on the holder for synchronous and opposite pivoting of the guard and holder respectively about the guard and holder axes;

an actuator displaceable on the housing between an actuated position and an unactuated position;

the actuator is operatively engaged to the holder for moving the cutting edge and blade guard angularly apart respectively into the cutting positions on movement of the actuator between the unactuated and actuated positions; and spring means for urging the blade guard and blade holder respectively into the safety positions.

2. The utility knife defined in claim 1, wherein the holder and guard axes are parallel to each other.

3. The knife according to claim 1, wherein the actuator disengages from the holder on movement of the cutting edge from the cutting position away from the blade guard.

4. A knife comprising:

a housing extending in a predetermined direction;

a blade holder pivotal on the housing;

a blade in the blade holder, having a cutting edge, and pivotal on the housing with the blade holder between a safety position and a first cutting position;

an actuator movable on the housing and operatively connected to the blade holder for moving the blade holder from the safety position to the first cutting position;

a blade guard pivotal on the housing from a respective safety position in which the blade guard covers the cutting edge of the blade when in the blade holder is in the safety position into a respective cutting position in which the blade guard is spaced from the cutting edge and the cutting edge is freely accessible when the blade holder is in the first cutting position and from the respective cutting position into the respective safety position;

coupling means between the blade guard and the blade holder for synchronously pivoting the blade guard and the blade holder in opposite directions, whereby movement of the blade holder from the safety position into the first cutting position also moves the blade guard from the respective safety position into the respective cutting position; and a spring for pivotally biasing the blade guard and the blade holder respectively into the safety positions.

5. The knife according to claim 4, wherein the actuator disconnects from the holder on movement of the cutting edge from the first cutting position away from the blade guard.

6. The knife according to claim 4 further comprising a first coupling element movably coupled with the housing and movably coupled with the holder; and wherein the actuator is a handle with second coupling element that engages with the first coupling element to define the operative connection between the holder and the actuator.

7. The knife according to claim 6, wherein the coupling elements move out of engagement with each other by movement of the blade holder from the first cutting position into a second cutting position angularly offset from the first cutting position away from the safety position, thereby decoupling the handle from the blade guard.

* * * * *